US009574250B2

(12) United States Patent
Nagao et al.

(10) Patent No.: US 9,574,250 B2
(45) Date of Patent: Feb. 21, 2017

(54) FABRICATION METHOD FOR STEPPED FORGED MATERIAL

(75) Inventors: Shinya Nagao, Yasugi (JP); Etsuo Fujita, Yasugi (JP)

(73) Assignee: HITACHI METALS, LTD., Tokyo (JP)

( * ) Notice: Subject to any disclaimer, the term of this patent is extended or adjusted under 35 U.S.C. 154(b) by 589 days.

(21) Appl. No.: 14/112,171

(22) PCT Filed: Apr. 24, 2012

(86) PCT No.: PCT/JP2012/060974

§ 371 (c)(1),
(2), (4) Date: Oct. 16, 2013

(87) PCT Pub. No.: WO2012/147742

PCT Pub. Date: Nov. 1, 2012

(65) Prior Publication Data

US 2014/0041768 A1 Feb. 13, 2014

(30) Foreign Application Priority Data

Apr. 25, 2011 (JP) ..... 2011-096961

(51) Int. Cl.
*C21D 8/06* (2006.01)
*B21J 1/04* (2006.01)
(Continued)

(52) U.S. Cl.
CPC ..... *C21D 8/065* (2013.01); *B21J 1/04* (2013.01); *B21J 1/06* (2013.01); *B21K 1/10* (2013.01);
(Continued)

(58) Field of Classification Search
CPC ..... C21D 8/065; C21D 8/005
See application file for complete search history.

(56) References Cited

FOREIGN PATENT DOCUMENTS

JP 04-190941 A 7/1992
JP 04-276042 A 10/1992
(Continued)

*Primary Examiner* — Rebecca Lee
(74) *Attorney, Agent, or Firm* — Sughrue Mion, PLLC

(57) ABSTRACT

Provided is a method for fabricating a stepped forged material that can realize a uniform microscopic structure in both the large diameter flange portion and the small diameter shaft portion. This method for fabricating a stepped forged material comprises the following steps: a step for obtaining a primary forged material in which an austenite stainless steel billet is heated to 1000-1080° C., and, without any further heating, the material is forged by means of reciprocal forging into a round rod having along the entire length thereof a forging ratio of 1.5 or greater; a step for obtaining a secondary forged material, that forms the large diameter flange portion and the small diameter shaft portion, in which without reheating, the small diameter shaft portion is formed by means of reciprocal forging at a temperature where the surface temperature of the primary forged material never falls more than 200° C. lower than the abovementioned material heating temperature and the forging is completed before the surface temperature of the final forged portion falls more than 300° C. lower than the abovementioned heating temperature; and a step for performing a solution heat treatment in which the secondary forged material is heated to 1040-1100° C. for 30 minutes or longer.

4 Claims, 3 Drawing Sheets

(51) Int. Cl.

| | |
|---|---|
| ***B21J 1/06*** | (2006.01) |
| ***B21K 1/10*** | (2006.01) |
| ***C21D 6/00*** | (2006.01) |
| ***C21D 7/13*** | (2006.01) |
| ***C21D 8/00*** | (2006.01) |
| ***C21D 9/28*** | (2006.01) |

(52) U.S. Cl.
CPC ..... *C21D 6/004* (2013.01); *C21D 7/13* (2013.01); *C21D 8/005* (2013.01); *C21D 9/28* (2013.01); *C21D 2211/001* (2013.01)

(56) References Cited

FOREIGN PATENT DOCUMENTS

| | | | | | |
|---|---|---|---|---|---|
| JP | 06-093389 | A | | 4/1994 | |
| JP | 06093389 | A | * | 4/1994 | ..... C22C 38/00 |
| JP | 2003-251429 | A | | 9/2003 | |
| JP | 2003-334633 | A | | 11/2003 | |

* cited by examiner (PORTION A OF THE PRESENT INVENTION) 100μm (PORTION B OF THE PRESENT INVENTION) 100μm (PORTION A OF COMPARATIVE EXAMPLE) 100μm (PORTION B OF COMPARATIVE EXAMPLE) 100μm

FABRICATION METHOD FOR STEPPED FORGED MATERIAL

CROSS REFERENCE TO RELATED APPLICATIONS

This application is a National Stage of International Application No. PCT/JP2012/060974 filed Apr. 24, 2012 (claiming priority based on Japanese Patent Application No. 2011-096961 filed Apr. 25, 2011), the contents of which are incorporated herein by reference in their entirety.

TECHNICAL FIELD

The present invention relates to a method for producing a stepped forged material, in which austenite stainless steel is forged to form a flange portion and a small diameter shaft portion.

BACKGROUND ART

Conventionally, parts having a flange portion and a small diameter shaft portion made of austenite stainless steel have been used for machine parts and the like in the field of aircrafts and nuclear power or the like, and there is a case that significantly excellent toughness and strength are required.

When a so-called stepped forging, that is, forging into the shape having a flange portion and a small diameter shaft portion, is performed, what is required to achieve both toughness and strength is optimization of alloy structure. For example, JP-A-4-190941 (Patent Literature 1) points out a problem of coarsening of a structure due to working heat of only one heating, that is, in a case of forging without reheating during the forging, or a problem of occurrence of non-uniform microscopic structure in a case where reheating is performed during the forging. To solve these problems, Patent Literature 1 discloses a method in which a radial forging machine is applied to perform extend forging of a small diameter portion in two stages or more, not at one time, and to perform extend forging only in one direction.

Moreover, according to JP-A-2003-334633 (Patent Literature 2), as a method of forming a flange portion and a shaft portion with sufficient yield in a short time, a two-shot or four-shot forging method is provided.

CITATION LIST

Patent Literature

Patent Literature 1: JP-A-4-190941
Patent Literature 2: JP-A-2003-334633

SUMMARY OF INVENTION

Technical Problem

The problem pointed out by Patent Literature 1 is a method especially focusing on a structure of a small diameter portion in stepped forging.

By the way, according to the study by the present inventors concerning a stepped forging of austenite stainless steel, while the problem of coarsening of a structure due to working heat can be solved by optimization of the heating temperature and a forging ratio, the inventors face a problem that it is difficult to achieve miniaturization of a structure of especially a large diameter flange portion.

In particular, in production from a billet, compared to the large diameter flange portion, a small diameter shaft portion can have a large forging ratio and can accumulate strain in adjustment of the forming temperature and the forging ratio, and a structure having fine recrystallized grains can be obtained in a solution heat treatment after forging. However, the large diameter flange portion cannot increase the forging ratio compared to the small diameter shaft portion and it is unlikely to obtain a uniform microscopic structure.

Moreover, in a case where a heating step is inserted before or during formation of the small diameter shaft portion, such a problem occurs that a structure of the flange portion becomes coarse due to a solution heat treatment after forging.

An object of the present invention is to provide a method of producing a stepped forged material that allows the large diameter flange portion whose structure is inclined to be coarse to have a uniform microscopic structure and also allows a structure of the small diameter shaft portion to have a uniform microscopic structure.

Solution to Problem

The present inventors apply a step in which heating the flange portion is performed before forging and after that no heating is performed in a forging step, and find out the forging condition compatible with this step that can obtain a uniform microscopic structure to arrive at the present invention.

That is, the present invention is a method for producing a stepped forged material including the steps of: obtaining a primary forged material, in which an austenite stainless steel billet for forging is heated to 1000-1080° C., and, without any further heating, the material is forged into a round rod having a forging ratio of 1.5 or greater along the entire length of the material by means of reciprocal forging of repeating a forging operation in which the material is delivered from one end to the other end in the axial direction with respect to a forging apparatus and thereafter delivered in the opposite direction;

obtaining a secondary forged material formed to have a large diameter flange portion and a small diameter shaft portion, in which without reheating, forging is started at a temperature before a surface temperature of the primary forged material falls more than 200° C. lower than the abovementioned material heating temperature and the small diameter shaft portion is formed by means of reciprocal forging of repeating a forging operation in which the primary forged material is delivered from one end in the axial direction to a predetermined position with respect to the forging apparatus and thereafter delivered in the opposite direction and the forging is completed before a surface temperature of a final forged portion falls more than 300° C. lower than the abovementioned material heating temperature; and performing a solution heat treatment, in which the secondary forged material is heated to 1040-1100° C. for 30 minutes or longer.

In the present invention, preferably, a forging ratio to obtain the primary forged material is 1.5 to 1.9 and a forging ratio to obtain the small diameter shaft portion of the secondary forged material from the primary forged material is 3.0 or less.

Moreover, the forging to be applied to the present invention is preferably performed by a radial forging apparatus in which forging from four orthogonal directions in the radial direction of a shaft of a forged material is executed simultaneously and the forged material is delivered to the axial direction while rotating the shaft.

Advantageous Effects of Invention

According to the production method of a stepped forged material of the present invention, since a uniform microscopic structure can be obtained over the entire length of the stepped forged material, this is an effective means that obtains machine parts in the field of aircrafts and nuclear power or the like requiring high reliability.

DESCRIPTION OF EMBODIMENTS

Figure 1:
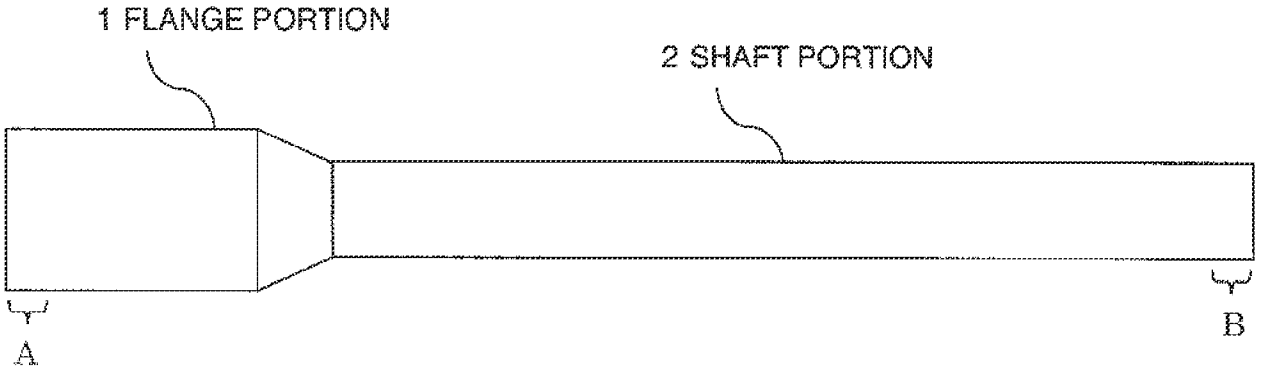
FIG. 1 is a drawing showing an example of a stepped forged material obtained by the method according to the present invention.

As described above, the important feature of the present invention is to apply the step in which heating the flange portion is performed before forging and after that no heating is performed in a forging step, and to find out the forging condition compatible with this step. This feature will be explained in detail hereinafter.

In the present invention, the intended material is austenite stainless steel. Austenite stainless steel is, among G4303 and G3214 of Japanese Industrial Standards for example, alloy with composition classified in austenite and its improved alloy.

These austenite stainless steels are steel with limited low carbon and material with excellent corrosion resistance to be used as many machine parts in the field of aircrafts and nuclear power. Moreover, in the austenite stainless steel, since Cr carbide is deposited due to a small amount of carbon existing in a hot working step, a solution heat treatment for dissolving this to increase corrosion resistance needs to be applied. As the temperature of the solution heat treatment is higher than the recrystallization temperature, recrystallization occurs due to remained strain in the hot working step. Unless sufficient strain remains before the solution heat treatment, the structure becomes coarse and a uniform microscopic structure with excellent strength and toughness cannot be obtained.

The present invention has found out a step of obtaining a uniform microscopic structure in this solution heat treatment that finally determines the structure.

In the present invention, first, a billet for forging is heated to 1000 to 1080° C. and, without any further heating, the material is forged into a round rod having a forging ratio of 1.5 or greater along the entire length of the material by means of reciprocal forging of repeating a forging operation in which this material is delivered from one end toward the other end in the axial direction with respect to a forging apparatus and thereafter delivered in the opposite direction to obtain a primary forged material.

In the present invention, if the heating temperature before the forging exceeds 1080° C., the heating temperature is so high that strain is released, which cannot cause sufficient strain to remain in the large diameter flange portion to be obtained in the forging. Moreover, when the heating temperature before the forging is less than 1000° C., the material cannot be softened sufficiently, so that cracking tends to occur in the forging. Further, grain size of the large diameter portion becomes non-uniform to be a mixed grain structure. Accordingly, in the present invention, the heating temperature is defined as 1000 to 1080° C.

Moreover, in the present invention, when heating is performed during the forging step, strain is not a little released and a microscopic structure cannot be obtained in the solution heat treatment. Consequently, excluding heating in the forging step is a fundamental requirement in the present invention.

Moreover, in the present invention, a forging operation in which the material is delivered from one end toward the other end in the axial direction with respect to the forging apparatus and thereafter delivered in the opposite direction is repeated. By forging with such reciprocal forging, the entire material can be uniformly forged. Thanks to the reciprocal forging, the forging time is shortened than that of a one-way forging, and forging can be performed within a constant temperature range to cause uniform strain to remain.

As to the forging apparatus to be applied to the present invention, a radial forging apparatus is effective, in which forging is executed simultaneously from four orthogonal directions and in the radial direction of a shaft of a forged material, and the forged material is delivered to the axial direction while rotating the shaft. The reason is that the radial forging apparatus can simultaneously apply pressure from the four orthogonal directions and is more excellent than a two surface forging apparatus in forming the round rod shape.

Moreover, in this step of determining the large diameter flange portion in the present invention, a forging ratio of 1.5 or greater is required to cause sufficient strain to remain.

Additionally, excessive forging ratio means sizing up the original material, which is not efficient. As an upper limit of the forging ratio, 1.9 is preferable.

Next, a secondary forged material that is formed to have the large diameter flange portion and the small diameter shaft portion is obtained. In this process, without reheating the obtained primary forged material, forging is started at a temperature before the surface temperature of the primary forged material falls more than 200° C. lower than the abovementioned material heating temperature, and the small diameter shaft portion is formed by means of reciprocal forging of repeating a forging operation in which the primary forged material is delivered from one end in the axial direction toward a predetermined position with respect to the forging apparatus and thereafter delivered in the opposite direction, and the forging is completed before the surface temperature of the final forged portion falls more than 300° C. lower than the abovementioned heating temperature.

In obtaining the secondary forged material, when the forging temperature is lowered to be significantly different from the forging temperature condition for obtaining the primary forged material forming the flange portion, a problem of forging defect due to ductility deterioration occurs. To avoid this, in the present invention, in the step of obtaining the secondary forged material forming the small diameter shaft portion, forging is started at a temperature before the surface temperature of the primary forged material falls more than 200° C. lower than the abovementioned material heating temperature, and the forging is completed before the surface temperature falls more than 300° C. lower than the abovementioned heating temperature.

In the step of obtaining the secondary forged material, the reason why the same reciprocal forging as in the step of obtaining the primary forged material is applied is to cause uniform strain to remain.

Moreover, in the abovementioned step of determining the small diameter shaft portion of the present invention, a forging ratio from an end surface of the round rod material to the predetermined position is preferably 3.0 or less. When the forging ratio becomes too large, defect and cracking, etc. tend to occur. Consequently, in the present invention, a forging ratio from the end surface of the billet to the predetermined position is 3.0 or less.

Additionally, here, a forging ratio refers to a forging ratio from the round rod material.

Next, a solution heat treatment is performed, in which the secondary forged material is heated at 1040 to 1100° C. for 30 minutes or more. As described above, this step of solution heat treatment is an important step to solve Cr carbide and to increase corrosion resistance. If the temperature of the solution heat treatment is low, recrystallization is not sufficiently advanced and miniaturization of crystal grain is difficult. On the other hand, if the temperature of the solution heat treatment is high, crystal grain becomes non-uniform and miniaturization of crystal grain is difficult. The time for the solution heat treatment is required to be 30 minutes or more.

EXAMPLE

The present invention will be explained in more detail with the following example.

A stepped forged material shown in FIG. 1 was produced from a billet for forging made of JIS G3214 SUS316 steel. First, an octagonal forging material of 320 mm×1700 mmL was heated to 1050° C., and without any further heating, forging was started in a radial forging apparatus. The used radial forging apparatus included ram cylinders in four directions, which execute forging with a feeding speed of 50 mm for one stroke and a rotation angle of 30°.

By repeating a forging operation in which the abovementioned material was delivered from one end to the other end in the axial direction with respect to the radial forging apparatus and thereafter delivered in the opposite direction, the entire length of the abovementioned material was subjected to reciprocal forging with a forging ratio of 1.6 to obtain a primary forged material with the diameter of 260 mm and the length of 2700 mm.

Next, without reheating, a forging was started with the surface temperature of the primary forged material being a temperature shown in Table 1, and by reciprocal forging of repeating a forging operation in which the material is delivered from one end in the axial direction to a three-quarter position in the longitudinal direction with respect to the forging apparatus and thereafter delivered in the opposite direction, a small diameter shaft portion with the diameter of 170 mm and a forging ratio of 2.3 to the primary forged material was formed. At this time, the forging was completed before the surface temperature of the final forged portion became the temperature shown in Table 1 to obtain the secondary forged material according to the present invention.

TABLE 1

| No | Forging start Temperature (° C.) | Forging completion Temperature (° C.) |
|---|---|---|
| 1 | 900 | 840 |
| 2 | 856 | 812 |
| 3 | 879 | 812 |
| 4 | 877 | 822 |
| 5 | 906 | 823 |
| 6 | 907 | 847 |
| 7 | 902 | 842 |
| 8 | 905 | 849 |
| 9 | 907 | 850 |
| 10 | 902 | 842 |

Moreover, as a comparative example, after obtaining the primary forged material in the same manner as the present invention, reheating was performed by holding the heating at 1050° C. for 3 hours, and then forging of forming the small diameter shaft portion was started. The subsequent forging condition was the same as in the present invention and the secondary forged material of the comparative example was obtained.

The obtained secondary forged materials according to the present invention and the comparative example were subjected to a solution heat treatment holding at 1050° C. for 120 minutes to obtain stepped forged materials.

FIG. 1 shows a schematic diagram of the obtained stepped forged material. From portion A and portion B shown in FIG. 1, a metal structure observation test piece was respectively obtained. Table 1 shows average grain size numbers of the present invention and the comparative example, and FIGS. 2 to 5 show photographs of representative (the present invention No. 1 and the comparative example) metal structures.

TABLE 2

| | A Flange portion grain size number | B Shaft portion grain size number |
|---|---|---|
| The present invention No. 1 | 4.5 | 4.5 |
| The present invention No. 2 | 4.0 | 4.0 |
| The present invention No. 3 | 3.5 | 4.0 |
| The present invention No. 4 | 4.0 | 4.0 |
| The present invention No. 5 | 4.0 | 4.0 |
| The present invention No. 6 | 4.0 | 4.0 |
| The present invention No. 7 | 4.0 | 4.0 |
| The present invention No. 8 | 4.0 | 4.0 |
| The present invention No. 9 | 4.0 | 4.0 |
| The present invention No. 10 | 4.0 | 4.0 |
| Comparative example | 2.0 | 3.5 |

Figure 2:
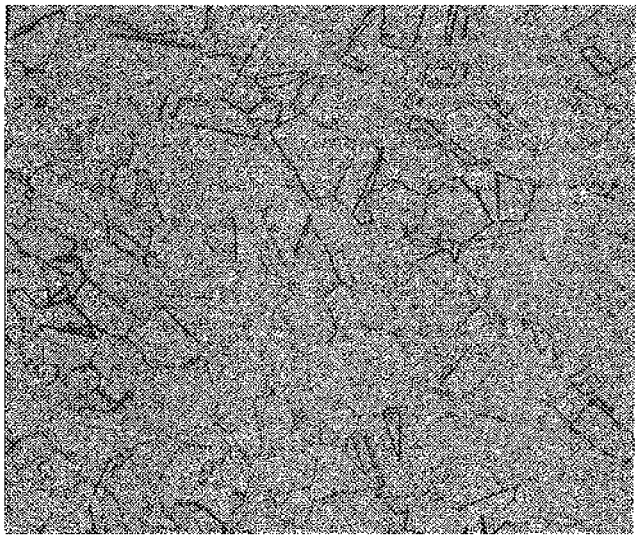
FIG. 2 is a microscope structure photograph showing an example of grain size observation of a flange portion of a stepped forged material produced according to the present invention.
Figure 3:
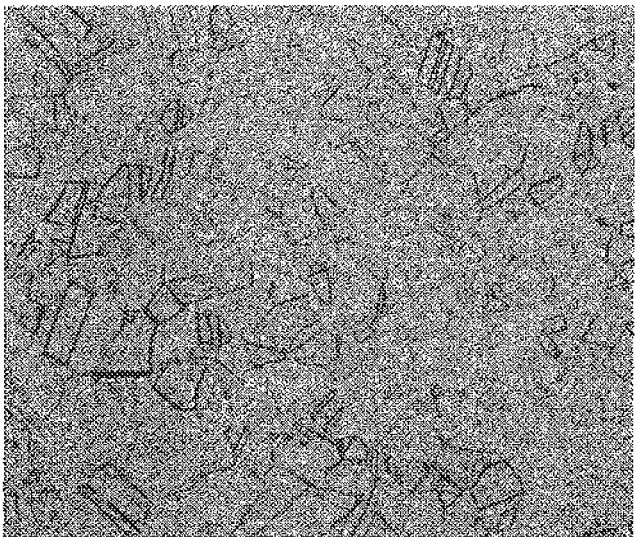
FIG. 3 is a microscope structure photograph showing an example of grain size observation of a shaft portion of the stepped forged material produced according to the present invention.

As shown in Table 2, FIGS. 2 and 3, in the present invention, the large diameter flange portion whose structure tends to be coarse had a uniform microscopic structure, and the small diameter shaft portion also had a uniform microscopic structure. Moreover, occurrence of forging defect was not confirmed.

Figure 4:
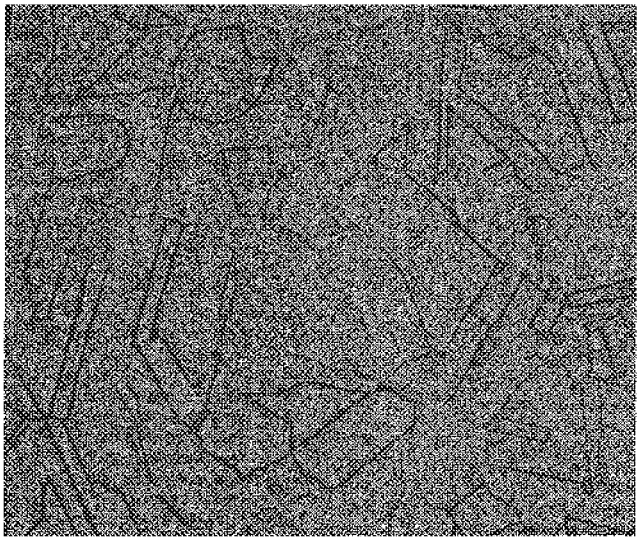
FIG. 4 is a microscope structure photograph showing an example of grain size observation of a flange portion of a stepped forged material produced according to a comparative example.
Figure 5:
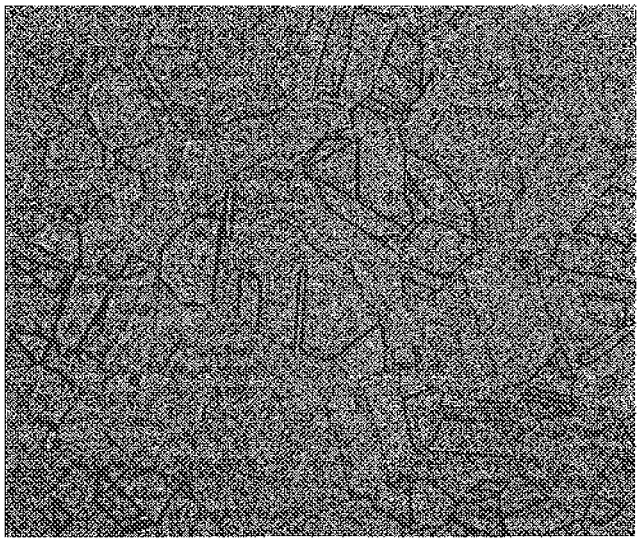
FIG. 5 is a microscope structure photograph showing an example of grain size observation of a shaft portion of the stepped forged material produced according to a comparative example.

On the other hand, in the comparative example, as shown in Table 2 and FIGS. 4 and 5, the grain size of the flange portion was coarse to be 2.0. Moreover, the grain size of the shaft portion was coarse compared to the present invention and wide variation was confirmed, and accordingly, an inferior structure to the present invention was obtained.

REFERENCE SIGNS LIST

1 flange portion
2 shaft portion

The invention claimed is:

1. A method for producing a stepped forged material, comprising the steps of:

obtaining a primary forged material, wherein an austenite stainless steel billet for forging is heated to 1000-1080° C., and, without any further heating, the material is forged into a round rod having a forging ratio of 1.5 or greater along the entire length of the material by means of reciprocal forging of repeating a forging operation in which the material is delivered from one end to the other end in the axial direction with respect to a forging apparatus and thereafter delivered in the opposite direction;

obtaining a secondary forged material formed to have a large diameter flange portion and a small diameter shaft portion, wherein without reheating, forging is started at a temperature before a surface temperature of the primary forged material falls more than 200° C. lower than the material heating temperature, and the small diameter shaft portion is formed by means of reciprocal forging of repeating a forging operation in which the primary forged material is delivered from one end in the axial direction to a predetermined position with respect to the forging apparatus and thereafter delivered in the opposite direction, and the forging is completed before a surface temperature of a final forged portion falls more than 300° C. lower than the material heating temperature; and performing a solution heat treatment, wherein the secondary forged material is heated to 1040-1100° C. for 30 minutes or longer.

2. The method for producing a stepped forged material according to claim 1, wherein a forging ratio to obtain the primary forged material is 1.5 to 1.9 and a forging ratio to obtain the small diameter shaft portion of the secondary forged material from the primary forged material is 3.0 or less.

3. The method for producing a stepped forged material according to claim 1, wherein the forging is performed by a radial forging apparatus, wherein forging from four orthogonal directions in the radial direction of a shaft of a forged material is executed simultaneously and the forged material is delivered to the axial direction while rotating the shaft.

4. The method for producing a stepped forged material according to claim 2, wherein the forging is performed by a radial forging apparatus, wherein forging from four orthogonal directions in the radial direction of a shaft of a forged material is executed simultaneously and the forged material is delivered to the axial direction while rotating the shaft.

* * * * *